US007343702B2

(12) United States Patent
Chao et al.

(10) Patent No.: US 7,343,702 B2
(45) Date of Patent: Mar. 18, 2008

(54) BICYCLE SHOE HAVING PROTECTIVE DEVICE

(76) Inventors: Kuo Chih Chao, 235 Chung-Ho Box, 8-24 Taipei (TW); Chia Pin Chen, 235 Chung-Ho Box, 8-24 Taipei (TW)

( * ) Notice: Subject to any disclaimer, the term of this patent is extended or adjusted under 35 U.S.C. 154(b) by 195 days.

(21) Appl. No.: 11/124,882

(22) Filed: May 9, 2005

(65) Prior Publication Data

US 2006/0080865 A1 Apr. 20, 2006

(30) Foreign Application Priority Data

Oct. 15, 2004 (TW) ..... 93216433 U

(51) Int. Cl.
*A43B 5/00* (2006.01)

(52) U.S. Cl. ..... 36/135; 36/131

(58) Field of Classification Search ..... 36/135, 36/131; 74/594.4, 594.5, 594.6
See application file for complete search history.

(56) References Cited

U.S. PATENT DOCUMENTS 550,409 A 11/1895 Hanson
4,893,420 A * 1/1990 Bezin et al. ..... 36/131
5,007,185 A * 4/1991 Lazarski ..... 36/135
5,031,342 A * 7/1991 Crook ..... 36/135
D451,261 S * 12/2001 Maher ..... D2/914

* cited by examiner

*Primary Examiner*—Ted Kavanaugh

(57) ABSTRACT

A bicycle shoe includes a shoe sole, a coupler member attached to bottom of the shoe sole, and a protective device attached to the coupling member, for contacting with ground, and for preventing the coupler member from being directly contacted with the ground, and for preventing the coupler member from being worn out. The protective device includes a lock notch formed in each of the front and the rear portions, and the coupler member includes a front portion and a rear portion for engaging into the lock notches of the protective device, for attaching the protective device to the coupler member. The protective device includes a retaining member for selectively attaching the shorter coupling members.

6 Claims, 8 Drawing Sheets

BICYCLE SHOE HAVING PROTECTIVE DEVICE

BACKGROUND OF THE INVENTION

1. Field of the Invention

The present invention relates to a bicycle shoe, and more particularly to a bicycle shoe having a protective device for protecting the bicycle shoe and for allowing the users to walk with the bicycle shoe.

2. Description of the Prior Art

Typical bicycle shoes comprise a coupling member attached to the bottom portion thereof, for attaching onto corresponding coupling member that is disposed or secured on the foot pedals of the bicycles, and for securing or coupling the shoe to the foot pedals of the bicycles, and for preventing the bicycle shoe from being disengaged from the foot pedals of the bicycles inadvertently, particularly while riding the bicycles.

For example, U.S. Pat. No. 550,409 to Hanson discloses one of the typical bicycle shoes comprising a coupling member attached to the bottom portion thereof, for engaging with and for coupling or securing to the bicycle foot pedals. Normally, the coupling member is made of solid metal or plastic materials, and is solidly attached to the bottom of the shoe and may not be disengaged from the shoe easily.

However, when the bicycle shoe is disengaged from the foot pedals of the bicycles, the solid coupling member may still be solidly attached to the shoe and extended out of the bicycle shoe, and may be directly engaged or contacted with the ground, such that the users may not easily walk with the bicycle shoes having the coupling member solidly attached to the bottom thereof.

The present invention has arisen to mitigate and/or obviate the afore-described disadvantages of the conventional shoes for cycles or bicycles.

SUMMARY OF THE INVENTION

The primary objective of the present invention is to provide a bicycle shoe including a protective device for attaching and protecting the coupling member of the bicycle shoe and for preventing the coupling member from being directly contacting with the ground, and for allowing the users to suitably walk with the bicycle shoe.

In accordance with one aspect of the invention, there is provided a bicycle shoe comprising a shoe sole, a coupler member attached to bottom of the shoe sole, and a protective device attached to the coupling member, for contacting with ground, and for preventing the coupler member from being directly contacted with the ground, and for preventing the coupler member from being worn out.

The protective device includes a front portion and a rear portion each having a lock notch formed therein, and the coupler member includes a front portion and a rear portion for engaging into the lock notches of the protective device, for attaching and coupling the protective device to the coupler member.

The protective device includes a chamber formed therein for receiving the coupler member therein, and includes an anchoring flange extended into the chamber from the front portion and the rear portion thereof, to form the lock notches therein.

The protective device includes a slot formed in each of the anchoring flanges thereof, to increase a resilience of the anchoring flanges, and to allow the front portion and the rear portion of the coupling member to easily engage into the lock notches of the protective device respectively.

The protective device includes a retaining member provided therein, for selectively engaging with the front portion of the coupling member which is not able to engage with the lock notch provided in the front portion of the protective device.

The protective device includes at least one opening formed therein, to define the retaining member. The protective device further includes a second opening formed therein, to form the retaining member between the opening and the second opening thereof.

The coupler member includes a bulge extended from the front portion thereof to form a shoulder therein, and/or extended from the rear portion thereof to form a shoulder therein. The coupler member is secured to the bottom of the shoe sole with at least one fastener and at least one anchoring board, and the anchoring board includes at least one orifice formed therein for weight reducing purposes.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
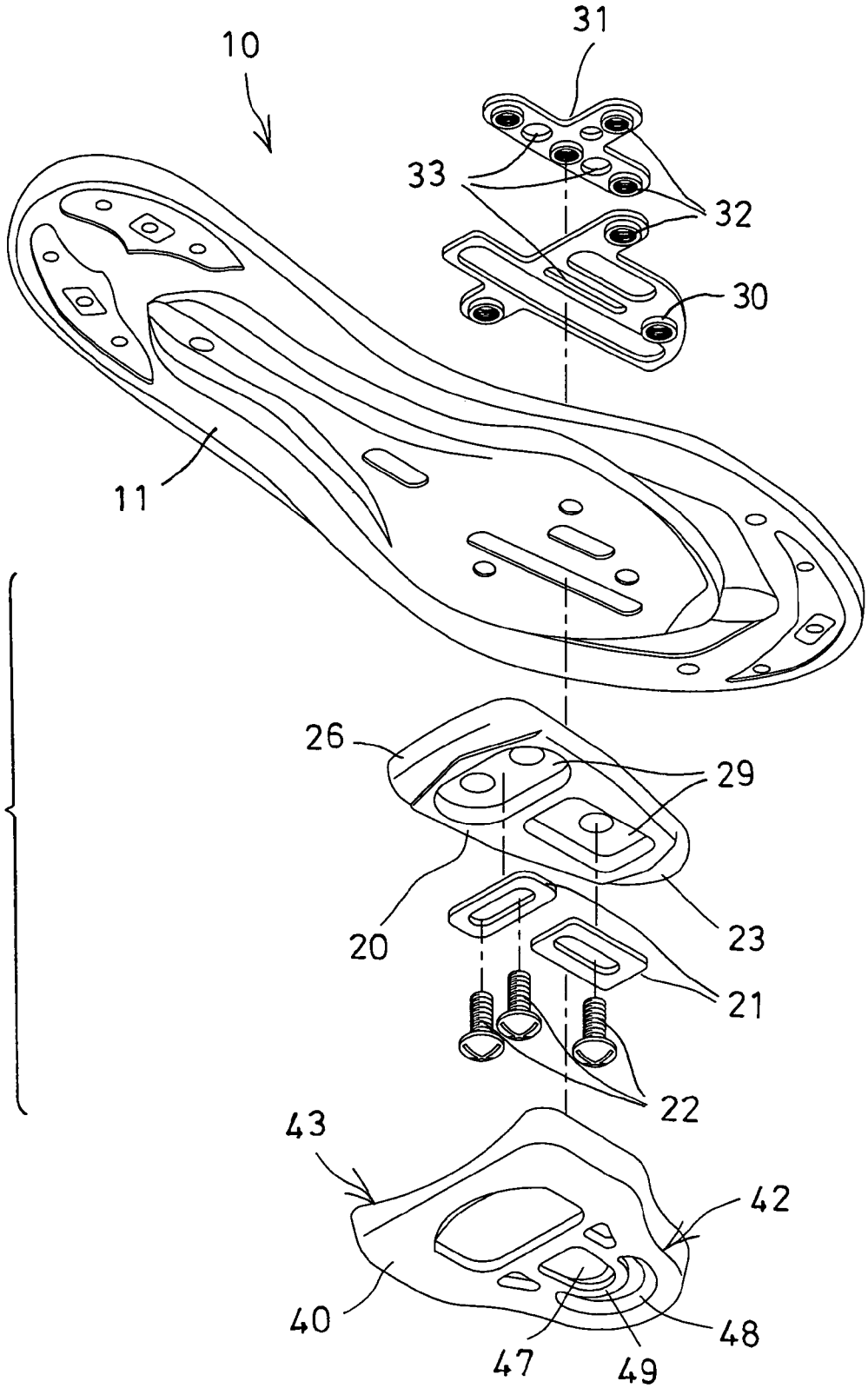
FIG. 1 is an exploded view of a bicycle shoe having a protective device in accordance with the present invention.
Figure 2:
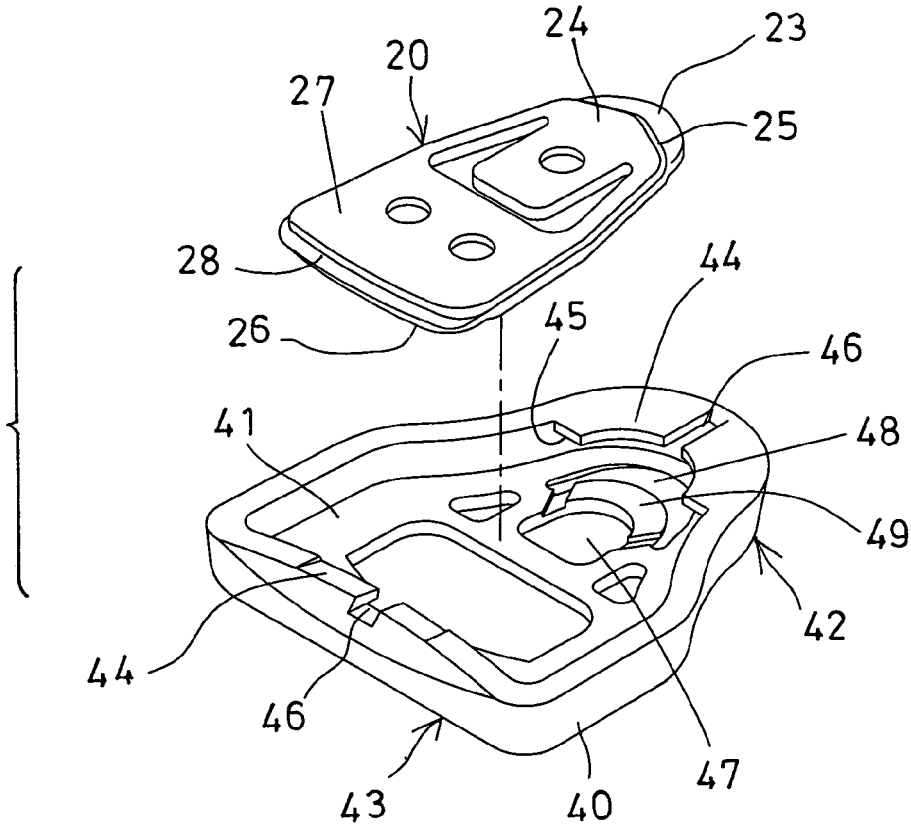
FIG. 2 is a partial exploded view of the protective device for the bicycle shoe.
Figure 3:
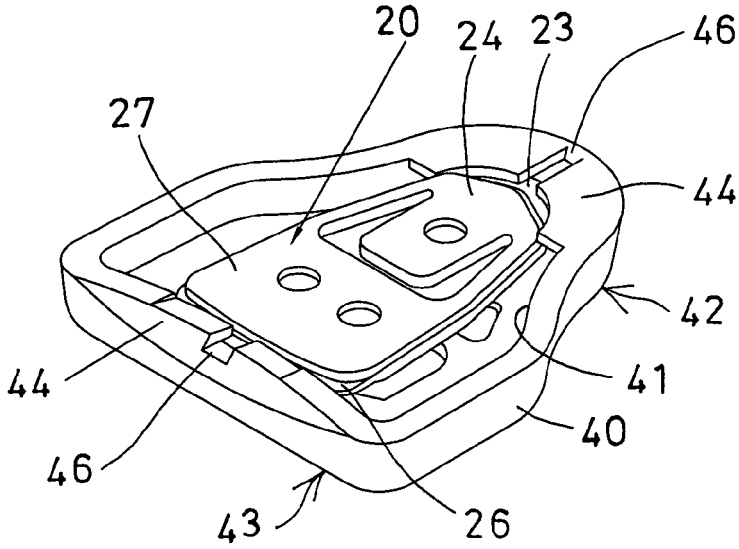
FIG. 3 is a perspective view of the protective device for the bicycle shoe.
Figure 4:
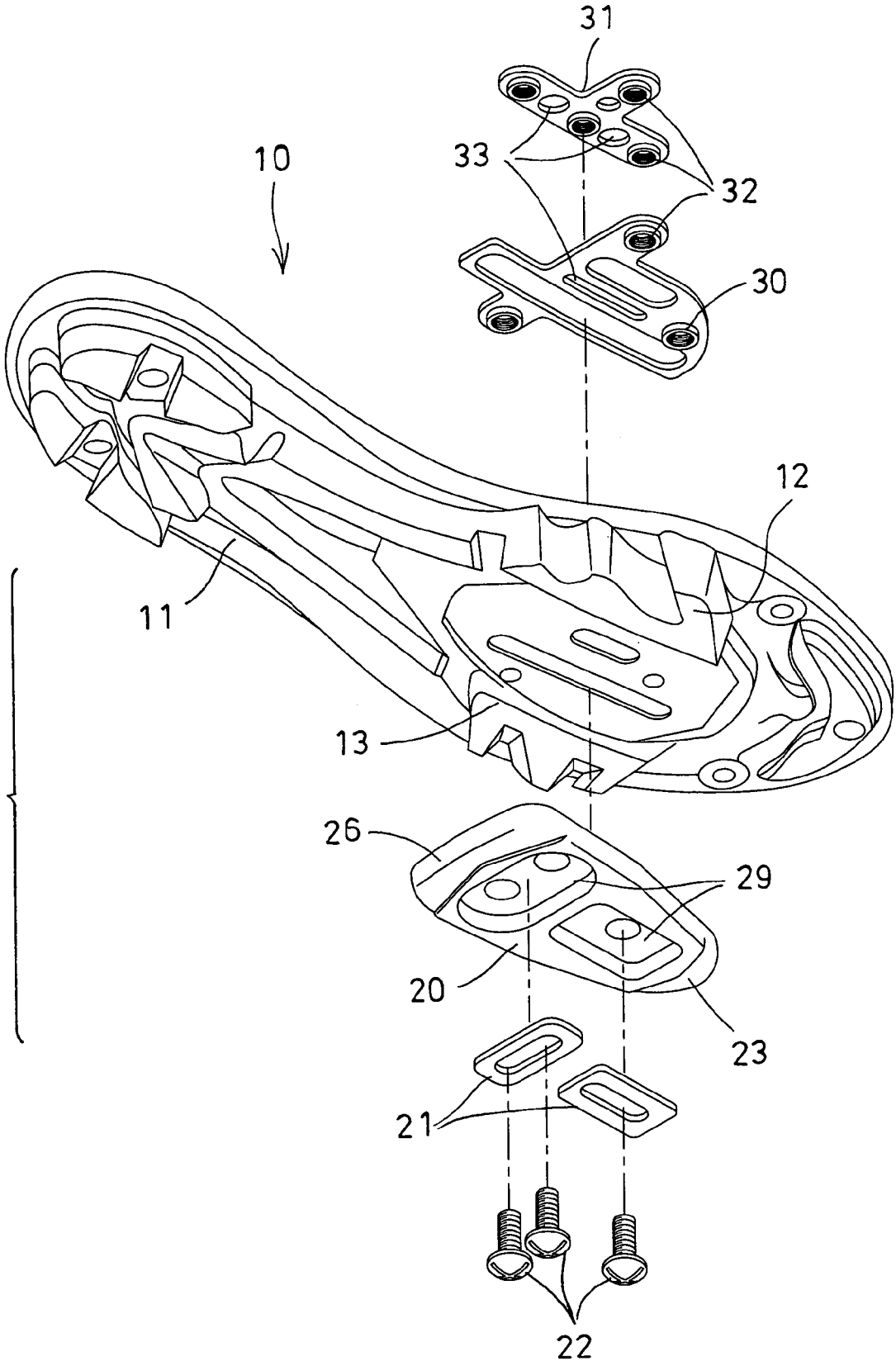
FIG. 4 is an exploded view similar to FIG. 1, illustrating the other application of the bicycle shoe.

Referring to the drawings, and initially to FIGS. 1-3, a bicycle shoe 10 in accordance with the present invention comprises a shoe sole 11 which is normally made of plastic materials, and a coupling member 20 secured to the front or middle portion of the bottom of the shoe sole 11 with such as washers 21 and/or fasteners 22 and/or anchoring boards 30, 31. The shoe sole 11 as shown in FIG. 1 is good for road cycling purposes. As shown in FIG. 4, the coupling member 20 may also be secured to the bottom of the shoe sole 11 that is good for mountain bike and that may include two swellings 12 extended therefrom for defining a depression 13 therebetween, to receive and to anchor the coupling member 20 between the swellings 12.

Figure 5:
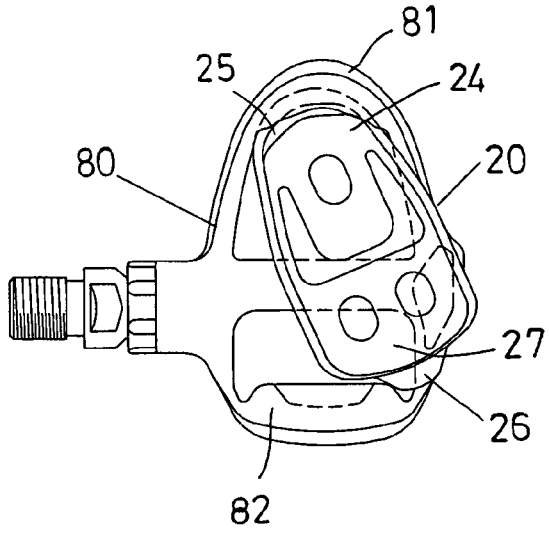
FIGS. 5, 6 are top plan views, illustrating the attachment of the coupler member to the foot pedal of the bicycle.
Figure 6:
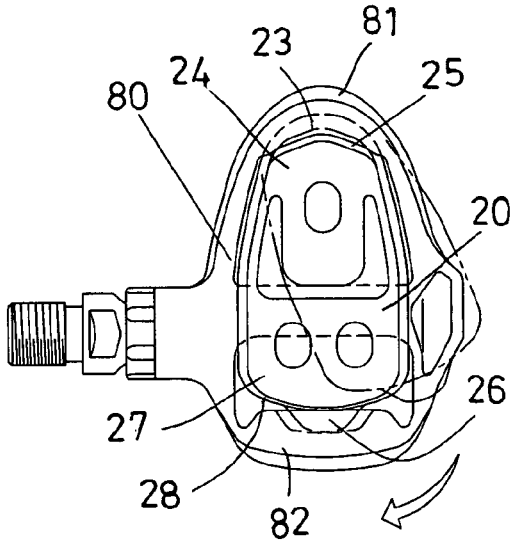
Figure 7:
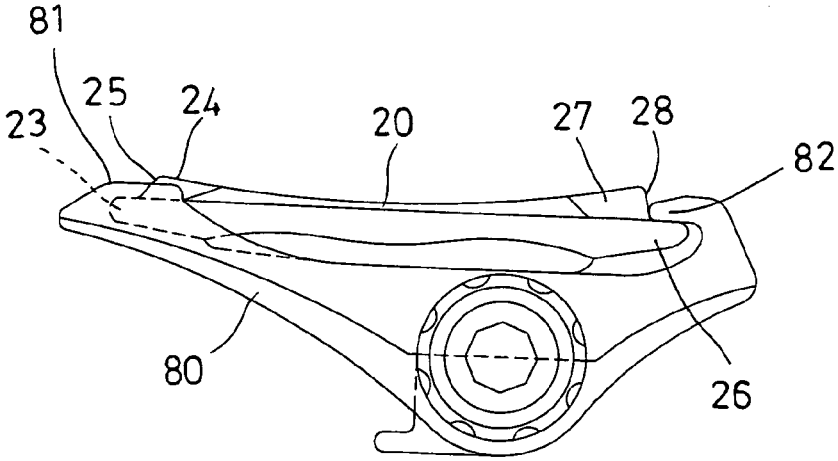
FIG. 7 is a plan view illustrating the coupler member and the foot pedal of the bicycle as shown in FIGS. 5 and 6.

As also shown in FIGS. 1-3, the coupling member 20 includes a front portion 23 having a bulge 24 extended therefrom to form or define a shoulder 25 therein, and includes a rear portion 26 also having a bulge 27 extended therefrom to form or define a shoulder 28 therein, As shown in FIGS. 5-7, the foot pedal 80 for the bicycles includes two anchoring members 81, 82 provided on the front and the rear portions thereof, for engaging with the front and the rear portions 23, 26 of the coupling member 20 respectively, and for detachably securing or coupling the coupling member 20 to the foot pedal 80. The attachment of the coupling member 20 to the foot pedal 80 has been filed in a co-pending application, and will not be described in further details.

The coupling member 20 may include one or more recesses 29 formed in the bottom thereof, for receiving and anchoring the washers 21, and for preventing the washers 21 from moving laterally relative to the coupling member 20. The anchoring boards 30, 31 each may include one or more screw holes 32 formed therein for threading or engaging with the fasteners 22, and each may further include one or more orifices 33 formed therein for such as weight reducing purposes.

A protective device 40 is provided for attaching to the bottom or the outer portion of the coupler member 20, and is made of resilient rubber or synthetic materials, for contacting with the ground, and for protecting the coupler member 20, and for preventing the coupler member 20 from being contacted with the ground, and thus for preventing the coupler member 20 from being easily worn out, and thus for suitably prolonging the working life of the coupler member 20.

The protective device 40 includes a chamber 41 formed therein for receiving the coupler member 20 therein, and includes a front portion 42 and a rear portion 43 each having an anchoring flange 44 extended into the chamber 41 thereof, to form or define a lock notch 45 in each of the front portion 42 and the rear portion 43 thereof, and for receiving or anchoring the front portion 23 and the rear portion 26 of the coupling member 20 respectively, and thus for detachably attaching or coupling the protective device 40 to the bottom or the outer portion of the coupler member 20, and for protecting the coupler member 20.

It is preferable that the protective device 40 includes one or more slots 46 formed in each of the anchoring flanges 44 thereof, to increase a resilience of the anchoring flanges 44, and for allowing the front portion 23 and the rear portion 26 of the coupling member 20 to be easily engaged into the lock notches 45 of the protective device 40 respectively. The protective device 40 includes one or more, such as two openings 47, 48 formed therein, to form or define a resilient retaining member 49 therein, or between the openings 47, 48 thereof.

Figure 8:
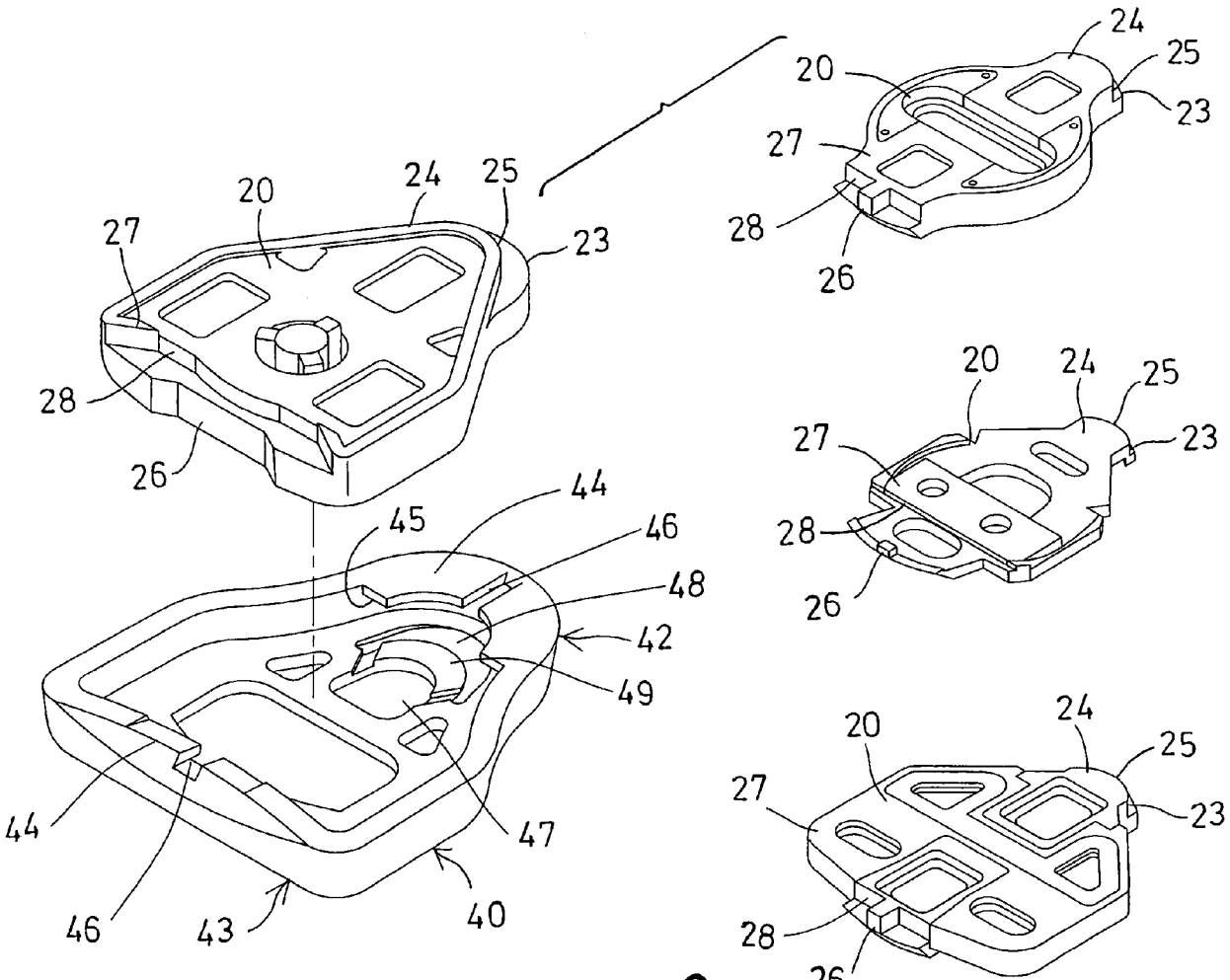
FIG. 8 is a partial exploded view illustrating the attachments of the protective device for the bicycle shoe to the other coupling members.
Figure 9:
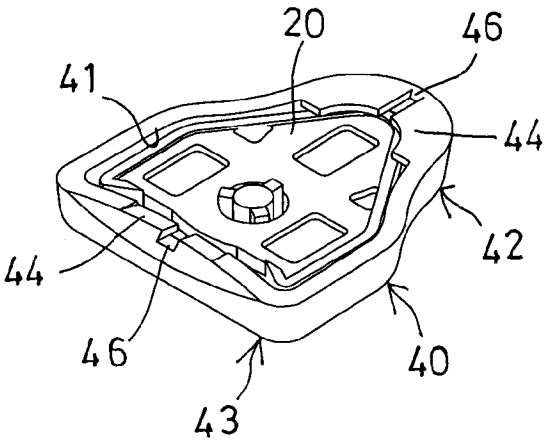

In operation, as shown in FIGS. 8-12, illustrated are the other coupling members 20 of different shapes and/or configurations and/or widths and/or lengths for attaching to the bicycle shoe and for coupling to the foot pedals of the cycles. For example, as shown in FIGS. 8 and 9, when the other coupling member 20 includes a length similar to that shown in FIGS. 1-7, the front portion 23 and the rear portion 26 of the other coupling member 20 may also be directly engaged into the lock notches 45 of the protective device 40 respectively, to attach or secure the other coupling member 20 to the protective device 40.

Figure 10:
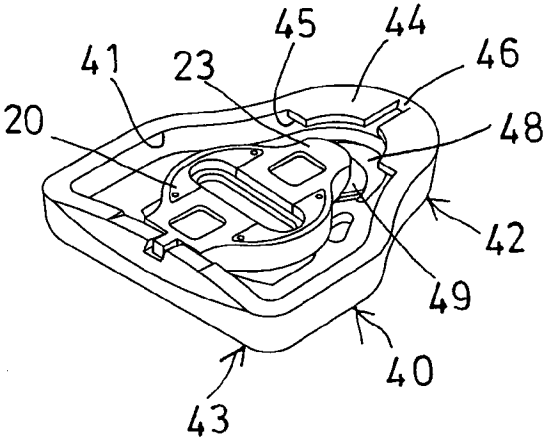
FIGS. 9, 10, 11, 12 are perspective views illustrating the attachments of the protective device for the bicycle shoe to the other coupling members as shown in FIG. 8.
Figure 12:
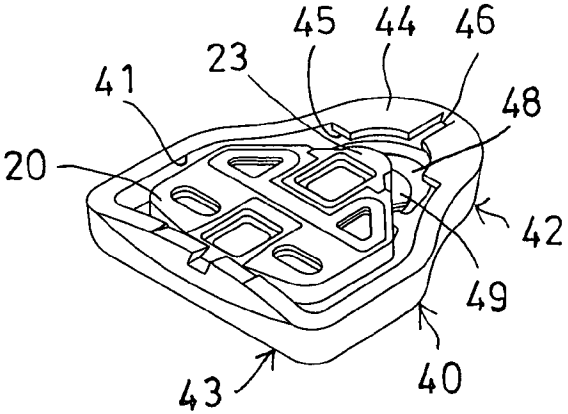
Figure 11:
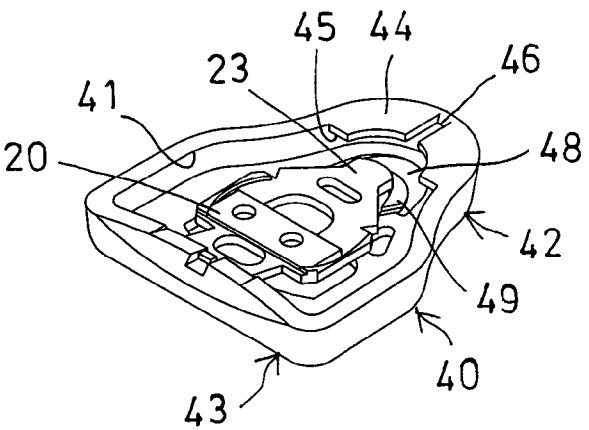

However, as shown in FIGS. 10-12, when the other coupling member 20 includes a length smaller or shorter than that shown in FIGS. 1-7 and 9, the rear portion 26 of the other coupling member 20 may also be directly engaged into the lock notch 45 at the rear portion 43 of the protective device 40, and the front portion 23 of the other coupling member 20 may be engaged into one of the openings 47 and may be engaged with the retaining member 49 of the protective device 40, for allowing the other coupling member 20 also to be attached or secured to the protective device 40, or on the contrary, for allowing the protective device 40 to be attached or secured to the other coupling member 20.

In operation, as shown in FIGS. 1, 3 and 9-12, after the coupling member 20 has been detached from the foot pedal 80, the protective device 40 may be attached or secured to the bottom or the outer portion of the coupling member 20, for contacting with the ground, and for preventing the coupler member 20 from being directly contacted with the ground, and thus for preventing the coupler member 20 from being easily worn out. The protective device 40 may be easily disengaged from the coupler member 20, and changed to the other new one, after the protective device 40 has been worn out.

Figure 13:
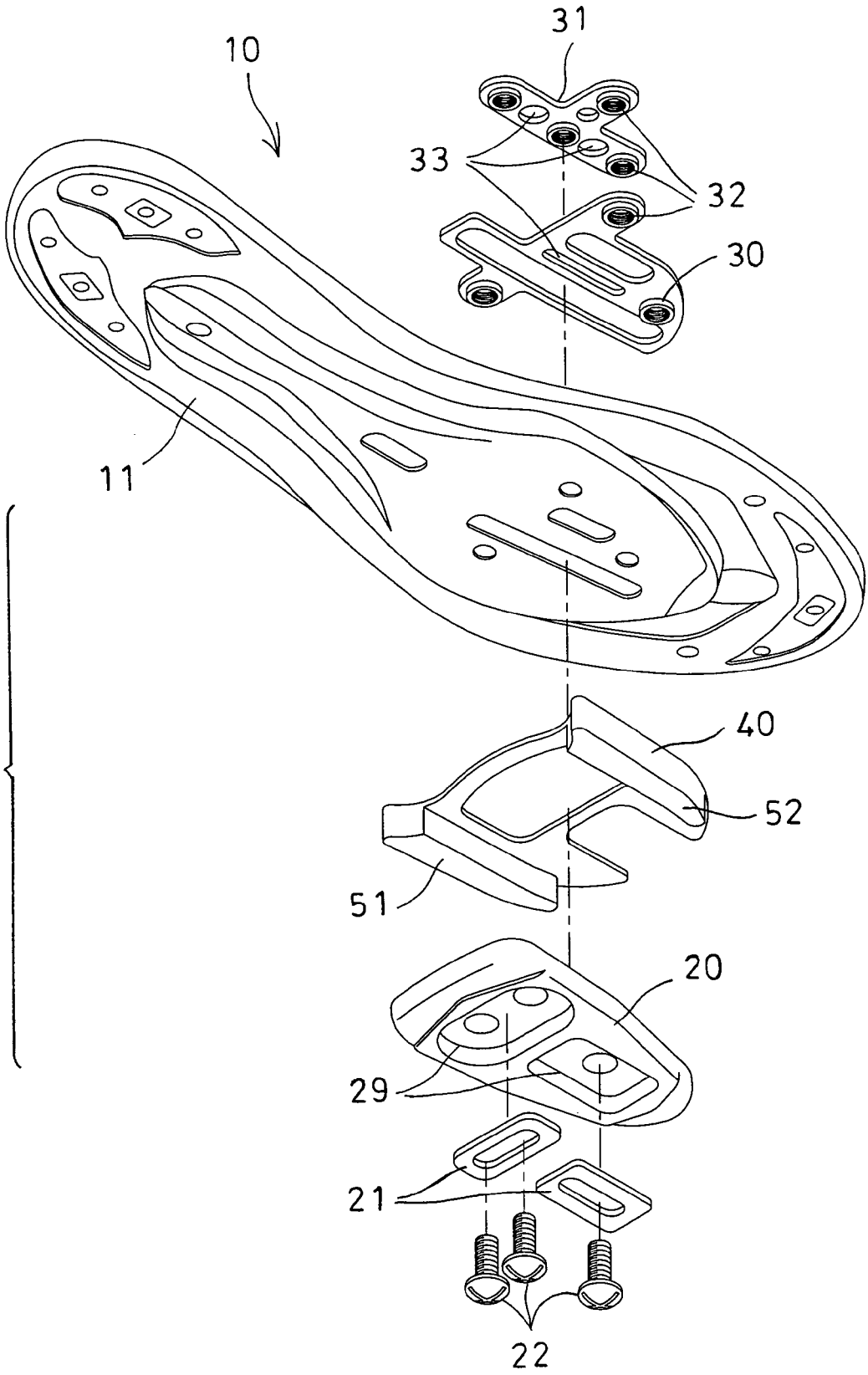
FIG. 13 is an exploded view similar to FIGS. 1 and 4, illustrating the further application of the bicycle shoe.
Figure 14:
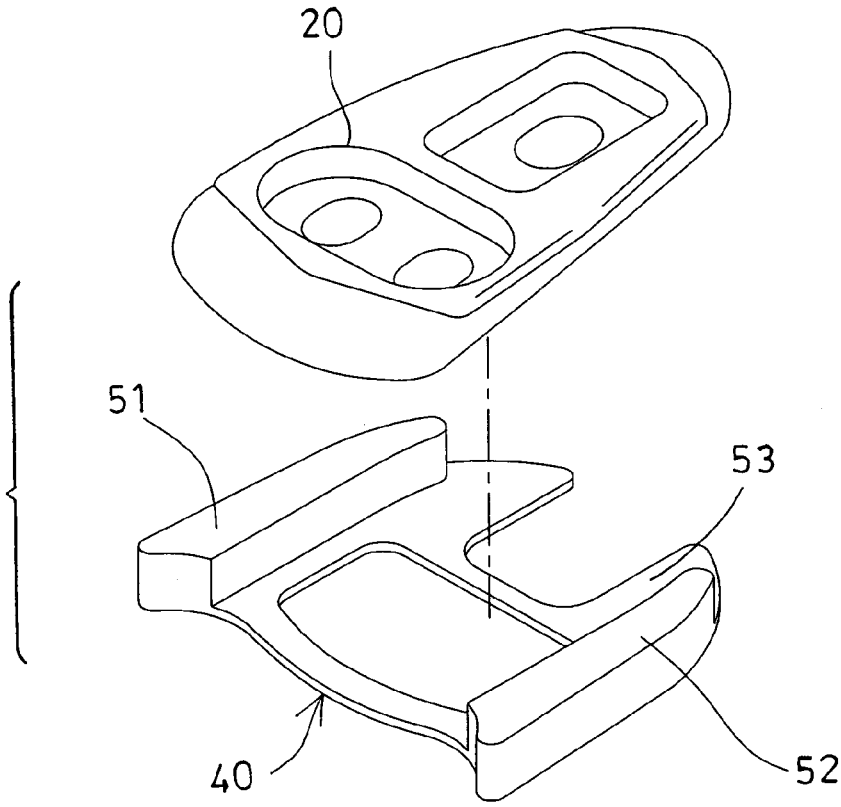
FIG. 14 is an exploded view illustrating the protective device of the bicycle shoe as shown in FIG. 13.
Figure 15:
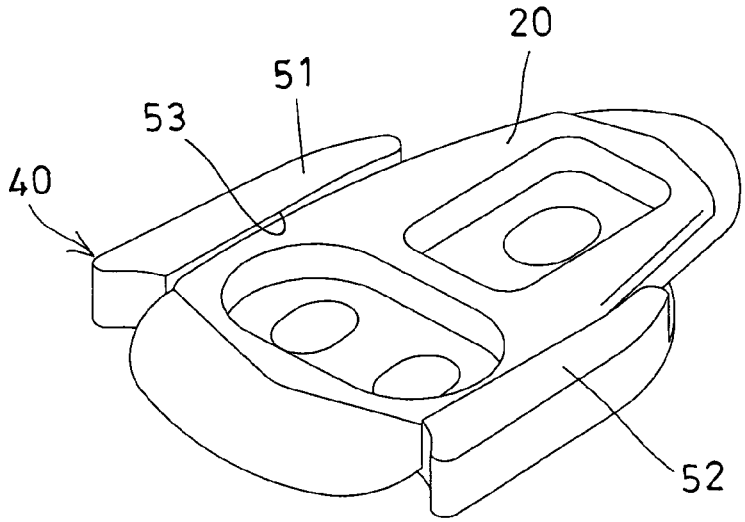
FIG. 15 is a perspective view illustrating the protective device of the bicycle shoe as shown in FIGS. 13 and 14.

Alternatively, as shown in FIGS. 13-15, the protective device 40 may also be directly secured between the shoe sole 11 and the coupler member 20 with the fasteners 22, and may include two protrusions 51, 52 extended therefrom, to form or define a cavity 53 therein, or between the protrusions 51, 52 thereof, for receiving and anchoring the coupler member 20. The protrusions 51, 52 of the protective device 40 preferably include a height greater than that of the coupler member 20, and are preferably extended beyond the coupler member 20, for contacting with the ground, and preventing the coupler member 20 from being directly contacted with the ground.

Accordingly, the bicycle shoe includes a protective device for protecting the coupling member of the bicycle shoe and for preventing the coupling member from being directly contacting with the ground, and thus for protecting the coupling member, and for allowing the users to suitably walk with the bicycle shoe.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A bicycle shoe comprising:

a shoe sole, a coupler member attached to bottom of said shoe sole, and including a front portion and a rear portion, a protective device attached to said coupling member, for contacting with ground, and for preventing said coupler member from being directly contacted with said ground, and for preventing said coupler member from being worn out, said protective device including a front portion and a rear portion each having a lock notch formed therein, and including a chamber formed in said protective device for receiving said coupler member therein, and including an anchoring flange extended into said chamber from said front portion and said rear portion of said protective device to form said lock notches in said protective device, said front portion and said rear portion of said coupler member being engageable into said lock notches of said protective device for attaching and coupling said protective device to said coupler member, said protective device including a slot formed in each of said anchoring flanges thereof, to increase a resilience of said anchoring flanges, and to allow said front portion and said rear portion of said coupling member to easily engage into said lock notches of said protective device respectively and said protective device including a retaining member provided therein for selectively engaging with said coupling member which is not able to engage with said lock notch provided in said protective device.

2. The bicycle shoe as claimed in claim 1, wherein said protective device includes at least one opening formed therein, to define said retaining member.

3. The bicycle shoe as claimed in claim 2, wherein said protective device further includes a second opening formed therein, to form said retaining member between said at least one opening and said second opening thereof.

4. The bicycle shoe as claimed in claim 1, wherein said coupler member includes a bulge extended from said front portion thereof to form a shoulder therein.

5. The bicycle shoe as claimed in claim 1, wherein said coupler member includes a bulge extended from said rear portion thereof to form a shoulder therein.

6. The bicycle shoe as claimed in claim 1, wherein said coupler member is secured to the bottom of said shoe sole with at least one fastener and at least one anchoring board, and said at least one anchoring board includes at least one orifice formed therein for weight reducing purposes.

* * * * *